US009308561B2

(12) United States Patent
Yamane et al.

(10) Patent No.: US 9,308,561 B2
(45) **Date of Patent: *Apr. 12, 2016**

(54) METHOD OF PRODUCING SEAMLESS METAL PIPE

(71) Applicant: NIPPON STEEL & SUMITOMO METAL CORPORATION, Tokyo (JP)

(72) Inventors: Kouji Yamane, Tokyo (JP); Tomio Yamakawa, Tokyo (JP); Kazuhiro Shimoda, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/353,035

(22) PCT Filed: Oct. 24, 2012

(86) PCT No.: PCT/JP2012/077495

§ 371 (c)(1),
(2) Date: Apr. 21, 2014

(87) PCT Pub. No.: WO2013/065554

PCT Pub. Date: Oct. 5, 2013

(65) Prior Publication Data

US 2014/0245806 A1 Sep. 4, 2014

(30) Foreign Application Priority Data

Nov. 1, 2011 (JP) ..... 2011-240610

(51) Int. Cl.
*B21B 19/04* (2006.01)
*B21B 23/00* (2006.01)
*B21B 19/06* (2006.01)

(52) U.S. Cl.
CPC ..... *B21B 23/00* (2013.01); *B21B 19/04* (2013.01); *B21B 19/06* (2013.01)

(58) Field of Classification Search
CPC ..... B21B 19/04; B21B 19/06; B21B 19/10; B21B 23/00; B21B 45/004
See application file for complete search history.

(56) References Cited

U.S. PATENT DOCUMENTS

| | | | | |
|---|---|---|---|---|
| 7,308,812 | B2 * | 12/2007 | Iida et al. | 72/42 |
| 7,536,888 | B2 * | 5/2009 | Yamakawa et al. | 72/97 |
| 2007/0181225 | A1 * | 8/2007 | Igarashi et al. | 148/410 |

FOREIGN PATENT DOCUMENTS

| | | |
|---|---|---|
| CN | 101020190 | 8/2007 |
| EP | 2 127 767 | 12/2009 |
| JP | 64-27707 | 1/1989 |
| JP | 04-187310 | 7/1992 |
| JP | 05-277516 | 10/1993 |
| JP | 10-128412 | 5/1998 |
| JP | 2002-239612 | 8/2002 |
| JP | 2008-161906 | 7/2008 |

* cited by examiner

*Primary Examiner* — Debra Sullivan
(74) *Attorney, Agent, or Firm* — Clark & Brody

(57) ABSTRACT

A method of producing a seamless metal pipe, which can suppress the occurrence of lamination defects, is provided. A method of producing a seamless metal pipe according to an embodiment of the present invention includes the steps of: heating a high alloy containing, by mass %, Cr: 20 to 30% and Ni: more than 22% and not more than 60% in a first heating furnace (S2); piercing-rolling the high alloy heated in the first heating furnace with a first piercing machine to produce a hollow shell (S3); heating the hollow shell in a second heating furnace (S4); and elongation-rolling the hollow shell heated in the second heating furnace with the first piercing machine or a second piercing machine which is different from the first piercing machine (S5).

5 Claims, 7 Drawing Sheets

METHOD OF PRODUCING SEAMLESS METAL PIPE

TECHNICAL FIELD

The present invention relates to a method of producing a seamless metal pipe.

BACKGROUND ART

Examples of the method of producing a seamless metal pipe include the Ugine Sejournet process based on a press method and the Mannesmann process based on a skew rolling method.

In the Ugine Sejournet process, a hollow round billet in which a through hole is formed at its axial center by machining or piercing press is prepared. Then, the hollow round billet is subjected to hot extrusion by use of an extrusion apparatus to produce a seamless metal pipe.

In the Mannesmann process, a round billet is piercing-rolled with a piercing machine to produce a hollow shell. The produced hollow shell is elongation-rolled with a rolling mill to reduce the diameter and/or thickness of the hollow shell, thus producing a seamless pipe. Examples of the rolling mill include a plug mill, a mandrel mill, a Pilger mill, a sizer, and the like.

The Ugine Sejournet process can process the round billet at a high reduction rate, and therefore is excellent in pipe workability. A high alloy generally has a high deformation resistance. Therefore, a seamless metal pipe made of a high alloy is produced mainly by the Ugine Sejournet process.

However, the manufacturing efficiency of the Ugine Sejournet process is lower than that of the Mannesmann process. In contrast, the Mannesmann process has high manufacturing efficiency and is capable of producing large diameter pipes and long pipes. Therefore, to produce a seamless metal pipe made of a high alloy, it is preferable to employ the Mannesmann process than the Ugine Sejournet process.

However, inner surface flaws attributed to lamination defects may occur in the inner surface of a high-alloy seamless metal pipe produced by the Mannesmann process. The lamination defect is caused by the melting of grain boundary within the wall of the hollow shell. As described above, a high alloy has a high deformation resistance. Further, when a high alloy has a high Ni content, solidus temperatures in the phase diagram thereof are low. When such a high alloy is piercing-rolled with a piercing machine, due to high deformation resistance thereof, work-induced heat will increase accordingly. Such work-induced heat causes a portion in the billet being piercing-rolled where temperature becomes close to or exceeds the melting point of the billet. In such a portion, the grain boundary melts, and a crack occurs. Such a crack is referred to as a lamination defect.

Techniques to suppress the occurrence of inner surface flaws of a hollow shell are proposed in JP2002-239612A (Patent Document 1), JP5-277516A (Patent Document 2), and JP4-187310A (Patent Document 3).

Patent Documents 1 and 2 disclose the following matters. Patent Documents 1 and 2 have an object to produce a seamless steel pipe made of austenitic stainless steel such as SUS304 etc. In Patent Documents 1 and 2, the starting material is formed into a hollow shell by machining and charged into a heating furnace. Then, the heated hollow shell is elongation-rolled with a piercing machine. The amount of reduction when a hollow shell is elongation-rolled is smaller compared with the case of a solid round billet. Therefore, the amount of work-induced heat decreases, and the occurrence of inner surface flaws is suppressed.

Patent Document 3 discloses the following matters. Patent Document 3 adopts a production method based on a so-called "double-piercing" method in which two piercing machines (a piercing machine and an elongator) are utilized in the Mannesmann process. Patent Document 3 has its object to suppress the occurrence of inner surface flaws of the hollow shell in the elongator. In Patent Document 3, the roll inclination angle and the elongation ratio of an elongator are adjusted to reduce the rolling load of the elongator. As a result, the occurrence of inner surface flows is suppressed. Other related literatures include JP64-27707A.

DISCLOSURE OF THE INVENTION

However, in Patent Documents 1 and 2, a billet is formed into a hollow shell by machining. Since the cost of producing a hollow shell by machining is high, the production cost of a seamless metal pipe becomes high as well. Further, when the hollow shell is produced by machining, the manufacturing efficiency will deteriorate.

Further, in Patent Document 3, although the rolling load of the elongator is reduced by adjusting the roll inclination angle and the elongation ratio of the elongator, inner surface flaws attributed to lamination defects may still occur.

It is an object of the present invention to provide a method of producing a seamless metal pipe which can suppress the occurrence of inner surface flaws attributed to lamination defects.

A method of producing a seamless metal pipe according to an embodiment of the present invention includes the steps of: heating a high alloy containing, by mass %, Cr: 20 to 30% and Ni: more than 22% and not more than 60% in a first heating furnace; piercing-rolling the high alloy heated in the first heating furnace with a first piercing machine to produce a hollow shell; heating the hollow shell in a second heating furnace; and elongation-rolling the hollow shell heated in the second heating furnace with the first piercing machine or a second piercing machine which is different from the first piercing machine.

The method of producing a seamless metal pipe according to the present embodiment can suppress the occurrence of inner surface flaws attributed to lamination defects.

BEST MODE FOR CARRYING OUT THE INVENTION

Figure 1:
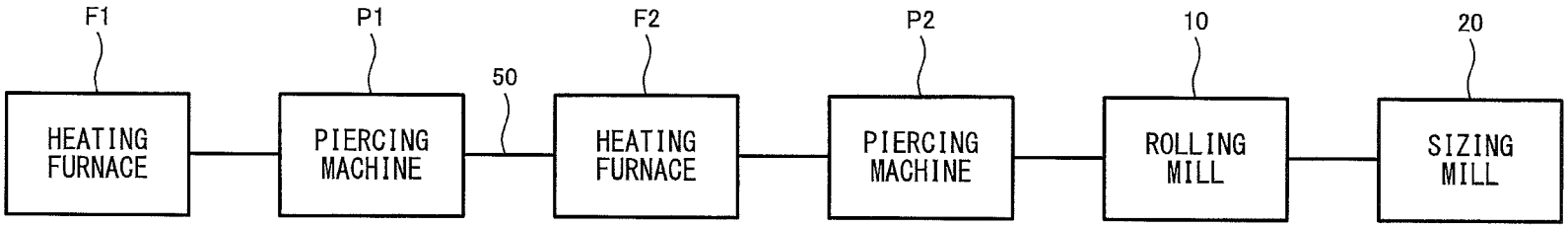
FIG. 1 is a general block diagram of a production line of a seamless metal pipe according to an embodiment of the present invention.

Hereafter, referring to the drawings, embodiments of the present invention will be described in detail. The same or corresponding parts in the drawings are denoted by the same reference characters so that the description thereof will not be repeated.

First Embodiment

When producing a high-alloy seamless metal pipe by the Mannesmann process, a double-piercing method is suitable. A high alloy has high deformation resistance. For that reason, when the reduction rate in one piercing rolling is high, the load against the piercing machine becomes larger compared with the case of general steels (such as low alloy steel). Further, since a higher reduction rate leads to larger work-induced heat, lamination defects become more likely to occur. Performing piercing-rolling and elongation-rolling with two piercing machines (a first and a second piercing machines) or one piercing machine, that is, exploiting a double-piercing method will make it possible to suppress the reduction rate per one piercing-rolling and elongation-rolling.

However, even when a double-piercing method is exploited for producing a high-alloy seamless metal pipe, a lamination defect may occur. Particularly, when a high-apply hollow shell produced by piercing-rolling is elongation-rolled with the first or the second piercing machine, lamination defects may possibly occur due to work-induced heat.

The present inventors studied a method of suppressing work-induced heat when producing a high-alloy seamless metal pipe by a double-piercing method. As a result, the present inventors have obtained the following findings.

The hollow shell after piercing-rolling has a temperature distribution in the thickness direction. The inner surface of the hollow shell during piercing-rolling is in contact with the plug thereby being subjected to heat dissipation, and the outer surface of the hollow shell is in contact with the skew roll thereby being subjected to heat dissipation. On the other hand, the temperature within the wall of the hollow shell (a center part of the wall thickness of the hollow shell) increases due to work-induced heat. Therefore, the temperatures of the inner surface and the outer surface of the hollow shell decrease, and the temperature within the wall becomes highest. In particular, since the size of the skew roll is large, the outer surface temperature becomes lower than the inner surface temperature in the hollow shell due to heat dissipation. Therefore, a temperature difference between the temperatures within the wall and at the outer surface becomes maximum. Hereafter, the temperature difference between the temperatures within the wall and at the outer surface of the hollow shell is referred to as "temperature deviation".

When a hollow shell having large temperature deviation is elongation-rolled, a lamination defect becomes likely to occur. As the reason of which, the following matters are assumed. Temperature deviation causes local concentration of strain within the wall of the hollow shell during elongation-rolling. Such concentration of strain remarkably increases the work-induced heat within the wall, consequently causing lamination defects.

Temperature deviation occurs during the piercing-rolling by the first piercing machine as described above, and remains even after the hollow shell is conveyed from the first piercing machine to the second piercing machine. To suppress such temperature deviation, the hollow shell is charged into a heating furnace to be reheated before the hollow shell after been piercing-rolled is elongation-rolled. This heating furnace serves to decrease the temperature deviation in the hollow shell. To be specific, the within-the-wall temperature of the hollow shell, which has excessively increased due to the work-induced heat during piercing-rolling, is decreased in this heating furnace, and the outer surface temperature thereof, which has decreased due to heat dissipation, is increased.

Thus, providing a heating furnace for decreasing temperature deviation makes it possible to suppress the temperature deviation in the hollow shell before elongation-rolling. For that reason, even in the case of a high-alloy hollow shell, it is possible to suppress the occurrence of lamination defects in the double-piercing method.

A method of producing a seamless metal pipe according to the present embodiment which has been completed based on the above described findings is as follows.

A method of producing a seamless metal pipe according to the present embodiment includes the steps of: heating a high alloy containing, by mass %, Cr: 20 to 30% and Ni: more than 22% and not more than 60% in a first heating furnace; piercing-rolling the high alloy heated in the first heating furnace with a first piercing machine to produce a hollow shell; heating the hollow shell with a second heating furnace; and elongation-rolling the hollow shell heated in the second heating furnace with the first piercing machine or a second piercing machine which is different from the first piercing machine.

In this case, the temperature deviation in the hollow shell after piercing rolling is decreased by the second heating furnace. For that reason, when the hollow shell is elongation-rolled, it is possible to suppress excessive increase in the within-the-wall temperature, thereby suppressing the occurrence of lamination defects. As a result, the occurrence of inner surface flaws of the seamless metal pipe is suppressed.

Preferably, in the step of heating the hollow shell in the second heating furnace, the hollow shell whose outer surface temperature is not less than 1000° C. is charged into the second heating furnace.

In this case, the second heating furnace effectively suppresses temperature deviation in the hollow shell. Further, the productivity and the production cost (fuel unit requirement) are improved.

Preferably, in the step of heating the hollow shell in the second heating furnace, the heating time shall be not less than 300 seconds.

If the heating time is not less than 300 seconds, temperature deviation in the hollow shell will be sufficiently small.

Preferably, in the step of piercing-rolling, a piercing ratio defined by Formula (1) is from 1.1 to not more than 2.0; and in the step of elongation-rolling, an elongation ratio defined by Formula (2) is from 1.05 to not more than 2.0, and a total elongation ratio defined by Formula (3) is more than 2.0.

Piercing ratio=hollow shell length after piercing-rolling/billet length before piercing-rolling (1)

Elongation ratio=hollow shell length after elongation-rolling/hollow shell length before elongation-rolling (2)

Total elongation ratio=hollow shell length after elongation-rolling/billet length before piercing-rolling (3)

In this case, a high-alloy seamless metal pipe can be produced at a high reduction rate.

Hereafter, details of the method of producing a seamless metal pipe according the present embodiment will be described.

[Production Facility]

FIG. 1 is a block diagram showing an example of a production line of a seamless metal pipe according to the present embodiment.

Referring to FIG. 1, the production line includes a heating furnace F1, a piercing machine P1, a heating furnace F2, a piercing machine P2, and a rolling mill (a rolling mill 10 and a sizing mill 20 in the present example). A conveyance system 50 is disposed between each facility. The conveyance system 50 is, for example, a conveyor roller, a pusher, a walking beam type conveyance system, and the like. The rolling mill 10 is, for example, a mandrel mill, and the sizing mill 20 is a sizer or a stretch reducer.

In FIG. 1, the heating furnace F2 which is different from the heating furnace F1 is disposed between the piercing machine P1 and the piercing machine P2. In FIG. 1, the heating furnace F2 is included in the production line. However, the heating furnace F2 may not be included in the production line, and may be disposed in a so-called off-line manner.

[Production Flow]

Figure 2:
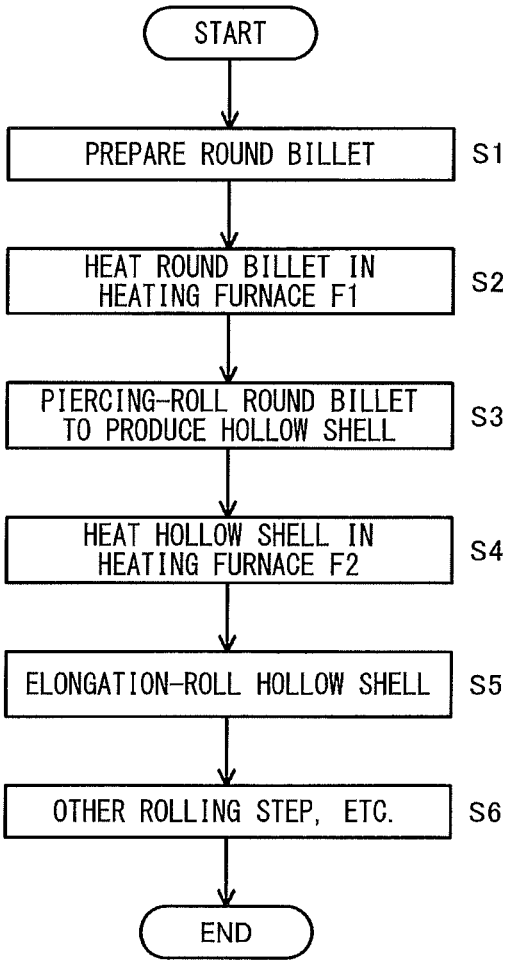
FIG. 2 is a flowchart showing production steps of a seamless metal pipe according to the present embodiment.

FIG. 2 is a flowchart showing production steps of a seamless metal pipe according to the present embodiment. The method of producing a seamless metal pipe according to the present embodiment performs the following steps. First, a high-alloy round billet is prepared (S1: preparation step). The prepared round billet is charged into the heating furnace F1 to be heated (S2: first heating step). The heated round billet is piercing-rolled with the piercing machine P1 to produce a hollow shell (S3: piercing-rolling step). The hollow shell is charged into the heating furnace F2 to be reheated (S4: second heating step). The heated hollow shell is elongation-rolled with a piercing machine P2 (S5: elongation-rolling step). The elongation-rolled hollow shell is rolled with the rolling mill 10 and the sizing mill 20 to be formed into a seamless metal pipe (S6). Hereafter, each step will be described in detail.

[Preparation Step (S1)]

First, a round billet made of a high alloy is prepared. The round billet contains, by mass %, 20 to 30% of Cr, and more than 22% and not more than 60% of Ni. Preferably, the round billet contains C: 0.005 to 0.04%, Si: 0.01 to 1.0%, Mn: 0.01 to 5.0%, P: not more than 0.03%, S: not more than 0.03%, Cr: 20 to 30%, Ni: more than 22% and not more than 60%, Cu: 0.01 to 4.0%, Al: 0.001 to 0.3%, N: 0.005 to 0.5%, the balance being impurities and Fe. Moreover, as needed, the round billet may contain, in place of part of Fe, one or more kinds of Mo: not more than 11.5% and W: not more than 20%. Further, the round billet may contain, in place of part of Fe, one or more kinds of Ca: not more than 0.01%, Mg: not more than 0.01%, Ti: 0.001 to 1.0%, V: 0.001 to 0.3%, Nb: 0.0001 to 0.5%, Co: 0.01 to 5.0%, and REM: not more than 0.2%.

The round billet is produced in a well-known method. For example, the round billet is produced by the following method. Molten steel having the above described chemical composition is produced. The molten steel is formed into an ingot by an ingot-making process. Alternatively, the molten steel is formed into a slab by a continuous casting process. The ingot or the slab is subjected to hot working to produce a billet. The hot working is, for example, hot forging. The high-alloy round billet may be produced by the continuous casting process. Moreover, the high-alloy round billet may be produced by any method other than the above described methods.

[First Heating Step (S2)]

The prepared round billet is charged into the heating furnace F1 to be heated. Preferable heating temperature is 1150 to 1250° C. When the round billet is heated in this temperature range, it is not likely that grain boundary melting occurs in the round billet during piercing-rolling. The upper limit of preferable heating temperature is not more than 1220° C. The heating time is not particularly limited.

The heating furnace F1 includes well-known configurations. For example, the heating furnace F1 may be a rotary furnace shown in FIG. 3, or a well-known walking beam furnace.

[Piercing-Rolling Step (S3)]

Figure 4:
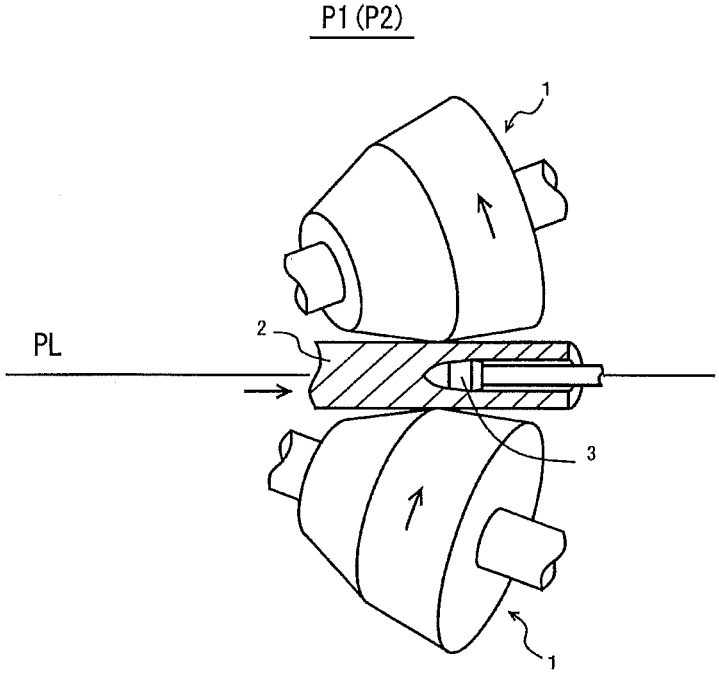
FIG. 4 is a schematic diagram of a piercing machine in FIG. 1.

The round billet heated in the heating furnace F1 is piercing-rolled with the piercing machine P1. FIG. 4 is a schematic diagram of the piercing machine P1. Referring to FIG. 4, the piercing machine P1 includes a pair of skew rolls 1 and a plug 2. The pair of skew rolls 1 are disposed on either side of a pass line PL so as to oppose to each other. Each skew roll 1 has an inclination angle and a crossing angle with respect to the pass line PL. The plug 2 is disposed between the pair of skew rolls 1 and on the pass line PL.

The round billet is withdrawn from the heating furnace F1. The withdrawn round billet is quickly conveyed to the entrance side of the piercing machine P1 by the conveyance system 50 (a conveyor roller, pusher, etc.). Then, the round billet is piercing-rolled with the piercing machine P1 to produce a hollow shell.

A preferable piercing ratio in the piercing-rolling is from 1.1 to not more than 2.0. The piercing ratio is defined by the following Formula (1):

Piercing ratio=Hollow shell length after piercing-rolling/Billet length before piercing-rolling (1)

When the piercing-rolling is performed within the above described range of the piercing ratio, lamination defects are not likely to occur. Further, when the heating temperature of the heating furnace F1 is less than 1100° C., the load in the piercing machine P1 becomes excessively large, and thereby piercing-rolling becomes difficult.

As the heating temperature increases, a lamination defect occurs at a lower piercing ratio. When the sum of the heating temperature of the round billet and the work-induced heat due to piercing-rolling exceeds the grain boundary melting temperature specific to the material, a lamination defect will occur. The work-induced heat decreases as the piercing ratio decreases. Therefore, as the heating temperature increases, a smaller piercing ratio is preferred.

[Second Heating Step (S4)]

Figure 3:
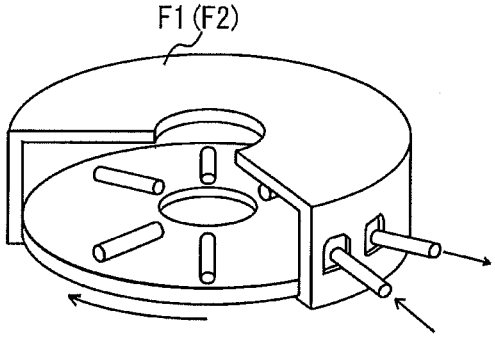
FIG. 3 is a schematic diagram of a heating furnace in FIG. 1.

The hollow shell produced by piercing-rolling is charged into the heating furnace F2 and heated. The heating furnace F2 has well-known configurations as with the heating furnace F1. Therefore, the second heating furnace may be, for example, a rotary furnace as shown in FIG. 3, or a walking beam furnace, and the like.

The within-the-wall temperature of the hollow shell immediately after piercing-rolling is remarkably higher than the outer surface temperature of the hollow shell. As described above, a value obtained by subtracting the temperature of the outer wall of the hollow shell from the temperature within-the-wall (at a center position of wall thickness) in a cross section (a section perpendicular to the axial direction of the hollow shell) of the hollow shell is defined as "temperature deviation" (° C.). When the piercing ratio is within the above described range, the temperature deviation will be about 100 to 230° C. When elongation-rolling is performed with the piercing machine P2 while the temperature deviation remains large, strain will locally concentrate within the wall due to the temperature deviation, and work-induced heat will remarkably increase. The increase in the work-induced heat becomes more remarkable as the temperature deviation increases. Therefore, if elongation-rolling is performed with the piercing machine P2 while the temperature deviation in the hollow shell remains large, lamination defects become more likely to occur in the hollow shell.

Accordingly, in the present embodiment, the heating furnace F2 is disposed so that the hollow shell after piercing-rolling is quickly charged into the heating furnace F2. Then, the hollow shell is heated in the heating furnace F2 at a temperature lower than the within-the-wall temperature of the hollow shell and higher than the outer surface temperature thereof. At this moment, the within-the-wall temperature of the hollow shell, which has excessively increased due to work-induced heat, decreases, and the outer surface temperature (and the inner surface temperature) of the hollow shell, which has decreased due to piercing-rolling, increases. This makes it possible to suppress the variation in temperature distribution of the hollow shell, thereby decreasing temperature deviation.

Figure 6:
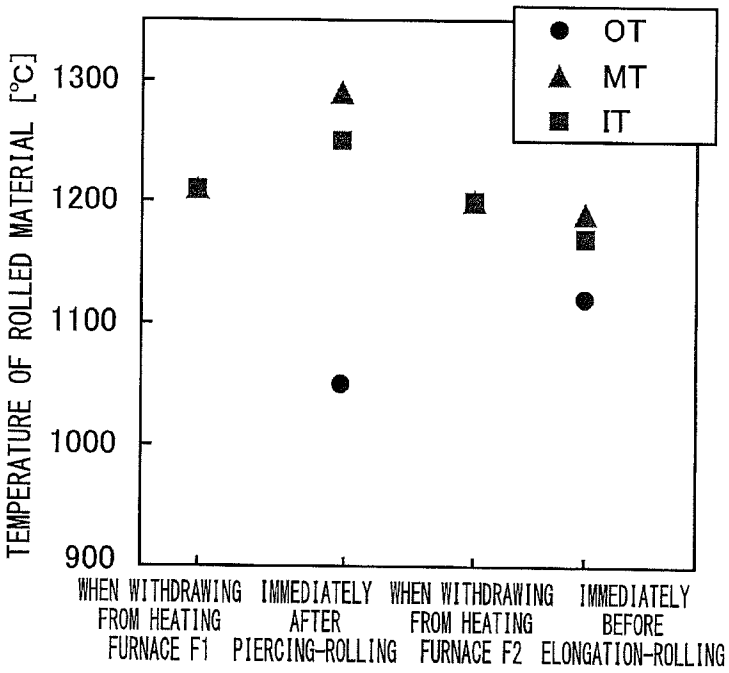
FIG. 6 is a diagram showing the transition of temperatures of the inner surface and the outer surface, and within the wall of the hollow shell at each step, when the hollow shell is elongation-rolled with a second piercing machine, after the hollow shell, which has been piercing-rolled, is reheated in a second heating furnace.
Figure 5:
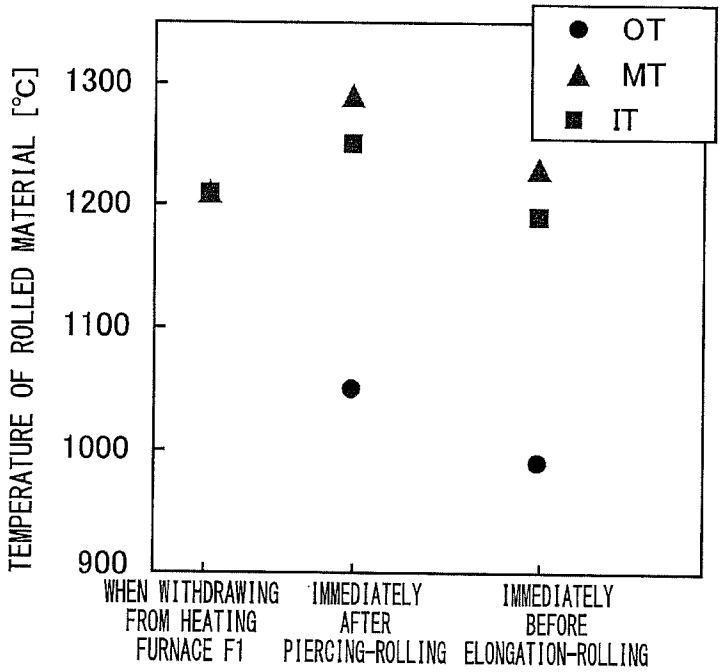
FIG. 5 is a diagram showing the transition of temperatures at inner surface and outer surface, and within the wall of the hollow shell at each step, when the hollow shell is elongation-rolled with a second piercing machine without being reheated after being piercing-rolled with a first piercing machine.

FIG. 5 is a diagram showing the transition of inner surface temperature, outer surface temperature, and within-the-wall temperature of the hollow shell at each step (at the time of withdrawing from the heating furnace F1, immediately after piercing-rolling, and immediately before elongation-rolling), when the hollow shell is elongation-rolled with the second piercing machine P2 without being reheated after being piercing-rolled with the first piercing machine P1. FIG. 6 is a diagram showing the transition of the inner surface temperature, the outer surface temperature, and the within-the-wall temperature of the hollow shell at each step (at the time of withdrawing from the heating furnace F1, immediately after piercing-rolling, withdrawing from the heating furnace F2, and immediately before elongation-rolling), when the hollow shell is elongation-rolled with the second piercing machine P2, after the hollow shell, which has been piercing-rolled, is reheated in the second heating furnace F2. FIGS. 5 and 6 are obtained by, the following numerical analysis.

A round billet made of a high alloy satisfying the above described chemical composition was assumed. It was supposed that the round billet had an outer diameter of 70 mm and a length of 500 mm; and the heating temperature of the heating furnace F1 was 1210° C. The hollow shell to be produced by piercing-rolling with the piercing machine P1 was supposed to have an outer diameter of 75 mm, a wall thickness of 10 mm, and a length of 942 mm. The piercing ratio was 1.88. The heating temperature of the heating furnace F2 was 1200° C. It was assumed that in the heating furnace F2, the hollow shell was heated for a sufficient amount of time until the inner surface temperature, the outer surface temperature, and the within-the-wall temperature of the hollow shell became the heating temperature (1200° C.). The hollow shell to be produced by elongation-rolling with the piercing machine P2 was supposed to have an outer diameter of 86 mm, a wall thickness of 7 mm, and a length of 1107 mm. The elongation ratio was 1.18. The conveyance time from the heating furnace F2 to the entrance side of the piercing machine P2 was supposed to be 20 seconds. The conveyance time (corresponding to FIG. 6) from the piercing machine P1 to the piercing machine P2 without passing through the heating furnace F2 was supposed to be 60 seconds.

Based on the above described production conditions, a numerical analysis model was constructed. Then, outer surface temperature OT, inner surface temperature IT, and within-the-wall temperature (temperature at a center position of the wall thickness) MT of the hollow shell were determined by a difference method. Based on each determined temperature, FIGS. 5 and 6 were created.

MT ("▲" mark) in FIGS. 5 and 6 indicates the within-the-wall temperature. IT ("■" mark) indicates the inner surface temperature. OT ("●" mark) indicates the outer surface temperature. Referring to FIG. 5, when reheating in the heating furnace F2 was not performed, the temperature deviation (difference value between the within-the-wall temperature MT and the outer surface temperature OT) after the piercing-rolling step was not less than 200° C., and the within-the-wall temperature MT was not less than 1280° C. Then, the temperature deviation amount immediately before elongation-rolling, that is, at the entrance side of the second piercing machine, was not less than 230° C. and the within-the-wall temperature MT was not less than 1230° C. That is, due to work-induced heat, the within-the-wall temperature MT became higher than the heating temperature of the heating furnace F1.

On the other hand, referring to FIG. 6, when reheating in the heating furnace F2 was performed, any of the outer surface temperature OT, the inner surface temperature IT, and the within-the-wall temperature MT of the hollow shell became 1200° C. in the heating furnace F2 so that the temperature deviation immediately after piercing-rolling was eliminated by the reheating. Moreover, the temperature deviation amount at the entrance side of the piercing machine P2 was also within 80° C. and the within-the-wall temperature MT was less than 1200° C.

From what has been described so far, it is possible to decrease the within-the-wall temperature MT of the hollow shell by means of the heating furnace F2, thus consequently decreasing temperature deviation. Therefore, it is possible to inhibit the melting of grain boundaries during elongation-rolling with the piercing machine P2, and suppress the occurrence of lamination defects.

A preferable hating temperature of the heating furnace F2 is 1100 to 1250° C. Preferably, the heating temperature of the heating furnace F2 is lower than the heating temperature of the heating furnace F1. The piercing machine P2 elongation-rolls a hollow shell. For that reason, the load imposed on the piercing machine P2 is smaller than that on the piercing machine P1 which piercing-rolls a solid round billet. Therefore, even when the heating temperature of the heating furnace F2 is lower than that of the heating furnace F1, it is possible to elongation-roll the hollow shell.

Considering the improvements in the productivity and the fuel unit requirement of the heating furnace F2, it is preferable that the piercing-rolled hollow shell is charged into the heating furnace F2 as soon as possible. However, there are often physical limitations attendant to the disposition of the piercing machine P1 and the heating furnace F2 in the production layout. Therefore, a certain amount of time is necessary for the hollow shell piercing-rolled with the piercing machine P1 to be charged into the heating furnace F2. However, by disposing the heating furnace F2 separately from the heating furnace F1, it is possible to quickly reheat the hollow shell after piercing-rolling, with the heating furnace F2.

The outer surface temperature of the hollow shell to be charged into the heating furnace F2 (that is, the outer surface temperature immediately before charging) is preferably not less than 1000° C., and further preferably is not less than 1050° C. In this case, a preferable heating time in the heating furnace F2 is not less than 300 seconds.

Figure 7:
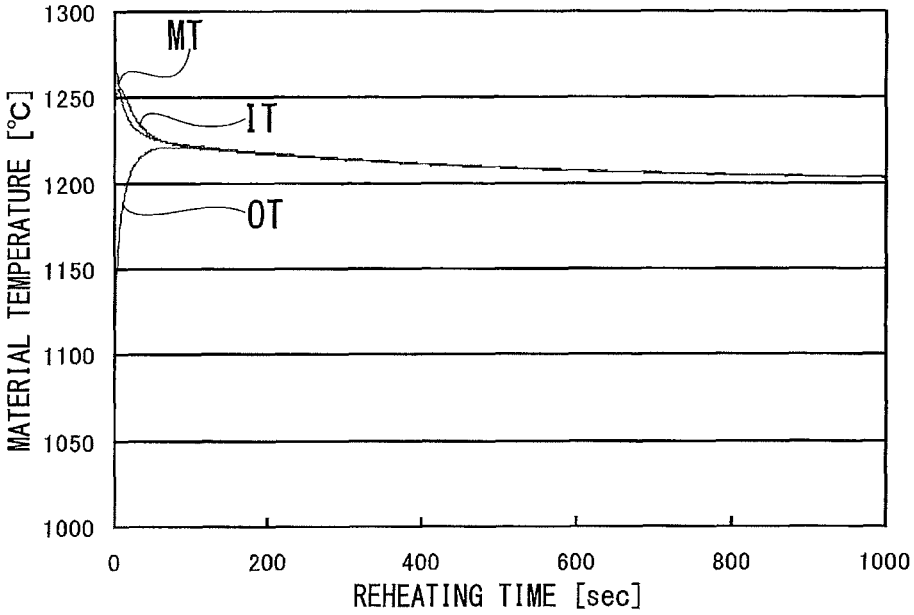
FIG. 7 is a diagram showing the relationship between the heating time in the second heating furnace and each of the outer surface temperature, the inner surface temperature, and the within-the-wall temperature of the hollow shell.
Figure 8:
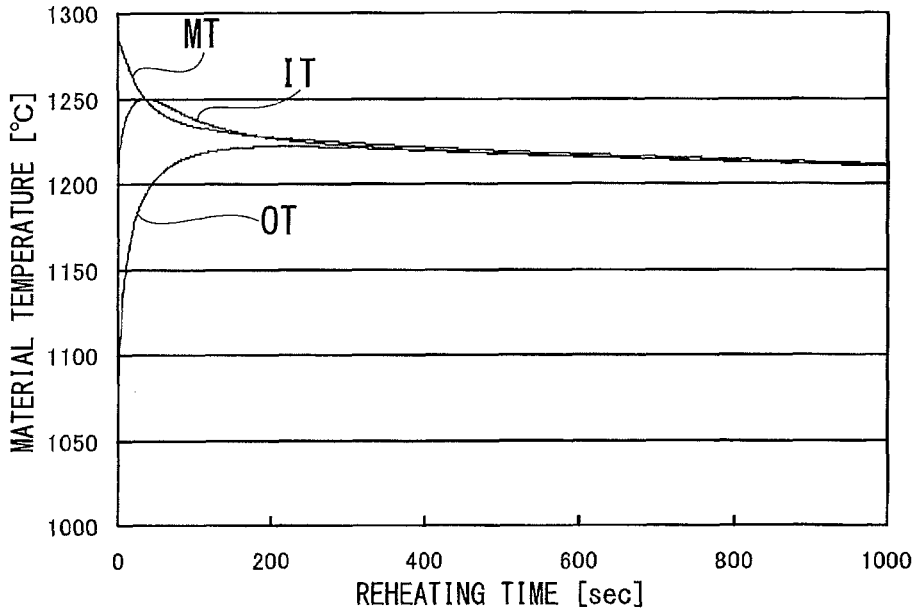
FIG. 8 is a diagram showing the relationship between the heating time in the second heating furnace and each of the outer surface temperature, the inner surface temperature, and the within-the-wall temperature of the hollow shell at a condition different from that in FIG. 7.
Figure 9:
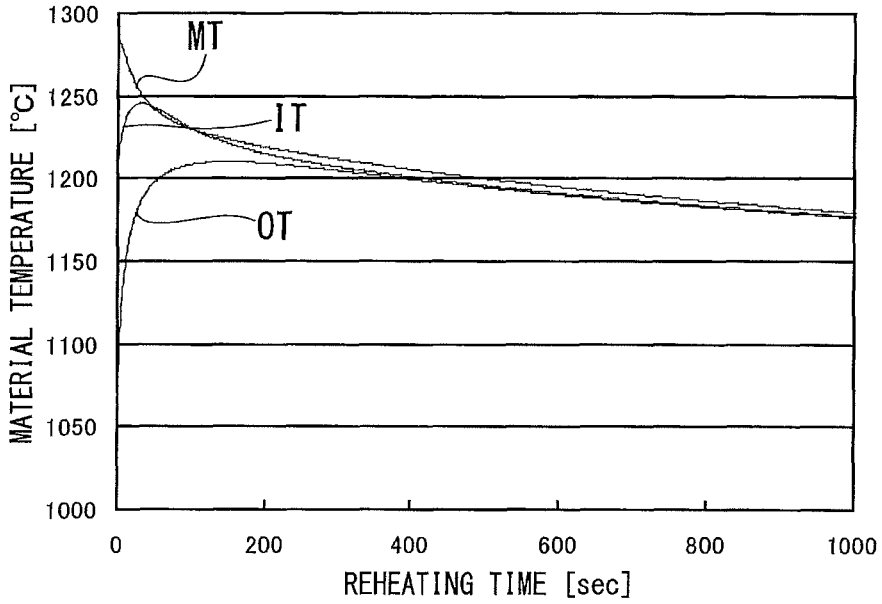
FIG. 9 is a diagram showing the relationship between the heating time in the second heating furnace and each of the outer surface temperature, the inner surface temperature, and the within-the-wall temperature of the hollow shell at a condition different from those in FIGS. 7 and 8.

FIGS. 7 to 9 are diagrams showing the relationship between the heating time in the second heating furnace F2 and each of the outer surface temperature OT, the inner surface temperature IT, and the within-the-wall temperature MT of the hollow shell. In FIG. 7, the heating temperature of the heating furnace F1 was 1210° C. and the heating temperature of the heating furnace F2 was 1200° C. The wall thickness of the hollow shell was 25 mm. Other conditions were set to be the same as those in FIG. 6. Based on those conditions described so far, a numerical analysis model was constructed. Then, the outer surface temperature OT, the inner surface temperature IT, and the within-the-wall temperature (temperature at a center position of the wall thickness) MT of the hollow shell at each heating time were determined by a difference method to create FIG. 7.

Compared with the conditions of FIG. 7, there was difference in the wall thickness of the hollow shell, which was 50 mm in FIG. 8. Other conditions were the same as those in FIG. 7. Compared with the conditions of FIG. 8, there was difference in the heating temperature of the heating furnace F2, which was 1150° C. in FIG. 9. Other conditions were the same as those in FIG. 8.

The curves MT in FIGS. 7 to 9 indicate the within-the-wall temperature (° C.) of the hollow shell. The curves IT indicate the inner surface temperature (° C.) of the hollow shell. The curves OT indicate the outer surface temperature (° C.) of the hollow shell. Referring to FIGS. 7 to 9, in any of the figures, temperature deviation becomes not more than 10° C. when the heating time passes at least 300 seconds. It is noted that in an early stage of heating in FIGS. 7 to 9, the inner surface temperature IT rises higher than the heating temperature due to the heat transfer from the furnace atmospheric temperature (that is, the heating temperature) of the heating furnace F2, and heat conduction from within-the-wall which has a within-the-wall temperature MT higher than the furnace atmospheric temperature (heating temperature). However, the inner surface temperature becomes closer to the heating temperature as time passes.

Figure 10:
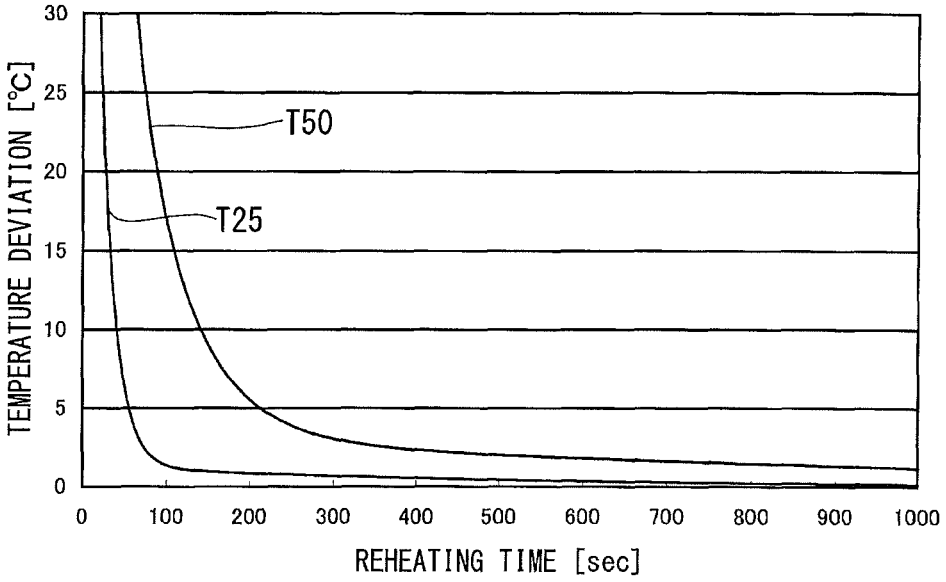
FIG. 10 is a diagram showing the relationship between the heating time in the second heating furnace and temperature deviation in the hollow shell.
Figure 11:
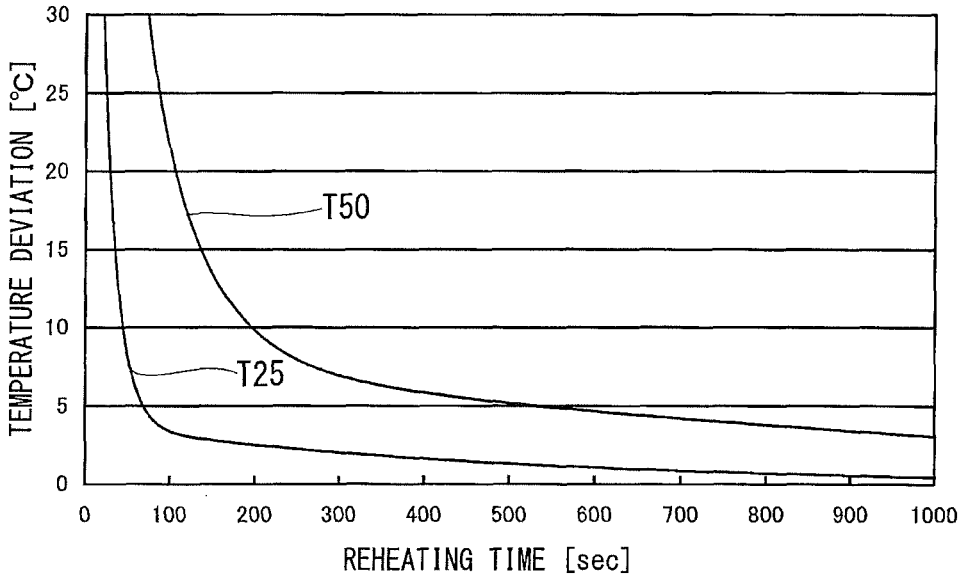
FIG. 11 is a diagram showing the relationship between the heating time in the second heating furnace and the temperature deviation in the hollow shell at a condition different from that in FIG. 10.

FIG. 10 is a diagram showing the relationship between the heating time in the heating furnace F2 and temperature deviation (the within-the-wall temperature MT—the outer surface temperature OT) in the hollow shell when the heating temperature of the heating furnace F1 is 1210° C. and the heating temperature of the heating furnace F2 is 1200° C. FIG. 11 is a diagram showing the relationship between the heating time in the heating furnace F2 and temperature deviation in the hollow shell when the heating temperature in the heating furnace F1 is 1210° C. and the heating temperature of the heating furnace F2 is 1150° C. The curves T25 in FIGS. 10 and 11 indicate temperature deviation when the wall thickness of the hollow shell is 25 mm. The curves T50 indicate temperature deviation when the wall thickness of the hollow shell is 50 mm. FIGS. 10 and 11 were created by editing the data of FIGS. 7 to 9.

Referring to FIGS. 10 and 11, temperature deviation rapidly decreases with passing of the heating time in the heating furnace F2 in either of the cases where the wall thicknesses are 25 mm and 50 mm. Then, when the heating time exceeds 300 seconds, the rate of decrease of temperature deviation with the passing of reheating time decreases. When the heating time is not less than 300 seconds, temperature deviation will become not more than 10° C.

FIGS. 7 to 11 show that performing heating for not less than 300 seconds in the heating furnace F2 will sufficiently decrease temperature deviation. Therefore, by employing a heating time of not less than 300 seconds, it is possible to suppress the occurrence of lamination defects in the following step, that is, elongation-rolling.

An upper limit of the heating time in the heating furnace F2 is preferably not more than 1000 seconds, and further preferably not more than 600 seconds. In this case, temperature deviation can be sufficiently decreased and besides the manufacturing efficiency is improved.

[Elongation-Rolling Step (S5)]

The hollow shell is withdrawn from the heating furnace F2 and conveyed to the piercing machine P2. Then, the hollow shell is elongation-rolled with the piercing machine P2.

The configuration of the piercing machine P2 is the same as that of the piercing machine P1 shown in FIG. 4. That is, the piercing machine 2 also includes a pair of skew rolls 1 and a plug 2. However, the shapes of the skew roll 1 and the plug 2 may be different from those of the piercing machine P1.

A preferable elongation ratio in the elongation-rolling is from 1.05 to not more than 2.0. The elongation ratio is defined by the following Formula (2).

$$\text{Elongation ratio} = \text{Hollow shell length after elongation-rolling}/\text{hollow shell length before elongation-rolling} \quad (2)$$

The relationship between the heating temperature of the heating furnace F2 and the elongation ratio is the same as in the case of the heating furnace F1. It is noted that when the heating temperature of the heating furnace F2 is less than 1100° C., elongation-rolling is difficult to be performed. Therefore, a preferable elongation ratio is from 1.05 to 2.0.

Further, a total elongation ratio defined by Formula (3) is preferably more than 2.0 and not more than 4.0.

$$\text{Total elongation ratio} = \text{Hollow shell length after elongation-rolling}/\text{billet length before piercing-rolling} \quad (3)$$

In the present embodiment, after piecing-rolling, the hollow shell is reheated (soaked) in the heating furnace F2. As a result, the within-the-wall temperature which has excessively increased due to work-induced heat of piercing-rolling is lowered, and thereby temperature deviation is decreased. For that reason, the occurrence of lamination defects is suppressed in elongation-rolling. Therefore, even if the total elongation ratio becomes higher than 2.0, the occurrence of inner surface flaws is suppressed.

[Steps after Elongating Step (S6)]

Steps after elongating step are the same as in the well-known Mannesmann process. For example, elongated hollow shell is elongation-rolled with a rolling mill 10. The rolling mill 10 includes a plurality of roll stands arranged in series. The rolling mill 10 is, for example, a plug mill and a mandrel mill, etc. Further, the hollow shell which has been elongation-rolled by the rolling mill 10 is sizing-rolled by a sizing mill 20. The sizing mill 20 includes a plurality of roll stands arranged in series. The sizing mill 20 is, for example, a sizer and a stretch reducer, etc. By the steps described so far, a seamless metal pipe made of a high alloy is produced.

Second Embodiment

In the first embodiment, elongation-rolling is performed by using the piercing machine P2. However, elongation-rolling may be performed with the piercing machine P1 in place of the piercing machine P2. In short, the piercing machine P1 piercing-rolls a round billet heated in the heating furnace F1 (S3 in FIG. 2), and further elongation-rolls a hollow shell heated in the heating furnace F2 (S5 in FIG. 2). Even in this case, the heating furnace F2 decreases an excessively high within-the-wall temperature, thereby decreasing temperature deviation. Therefore, even if the hollow shell is elongation-rolled with the piercing machine P1, lamination defects are not likely to occur.

EXAMPLES

A round billet made of a high alloy containing, by mass %, C: 0.02%, Si: 0.3%, Mn: 0.6%, Cr: 25%, Ni: 31%, Cu: 0.8%, Al: 0.06%, N: 0.09%, and Mo: 3%, the balance being Fe and impurities was prepared. The round billet was subjected to double piercing (piercing-rolling with a first piercing machine and elongation-rolling with a second piecing machine) to be formed into a seamless metal pipe. The presence of a lamination defect of the produced seamless metal pipes was investigated.

Inventive Example

Seamless metal pipes of Inventive Example were produced by the following method. Three round billets made of the high alloy having the above described chemical composition were prepared. Each round billet had an outer diameter of 70 mm and a length of 500 mm. Each round billet was charged into the heating furnace F1 to be heated at 1210° C. for 1 hour. After heating, the round billet was withdrawn from the heating furnace F1, and was piercing-rolled with the piercing machine P1 to be formed into a hollow shell. The hollow shell had an outer diameter of 75 mm, a wall thickness of 10 mm, and a length of 942 mm, and the piercing ratio was 1.88.

The hollow shell after piercing-rolling was quickly charged into the heating furnace F2 to be heated. The outer surface temperature of the hollow shape at the time of charging was 1050° C. The heating temperature in the heating furnace F2 was 1200° C., and the heating time thereof was 600 seconds (10 minutes).

After heating, the hollow shell was withdrawn from the heating furnace F2 and was elongation-rolled with the piercing machine P2 to produce a seamless metal pipe. The outer surface temperature of the hollow shell at the entrance side of the piercing machine P2 (that is, the outer surface temperature of the hollow shell immediately before elongation-rolling) was 1120° C. The produced seamless metal pipe had an outer diameter of 86 mm, a wall thickness of 7 mm, and a length of 1107 mm, and the elongation ratio was 1.18. The total elongation ratio was 2.21.

The presence or absence of a lamination defect in each produced seamless metal pipe was investigated. To be specific, each seamless metal pipe was cut along the axial direction after ultrasonic testing, and the presence or absence of a lamination defect on the inner surface thereof was visually observed. When even one lamination defect was observed, it was judged that the lamination defect had occurred in the seamless metal pipe.

Comparative Example

Seamless metal pipes of Comparative Example were produced by the following method. Three round billets having the same chemical composition and dimensions as those of Inventive Example were prepared. The round billets were heated in the heating furnace F1 under the same condition as in Inventive Example and were piercing-rolled with the piercing machine P1 to be formed into a hollow shell. The produced hollow shells had the same size as that of Inventive Example. Without being charged into the heating furnace F2, the produced hollow shells were elongation-rolled with the piercing machine P2 under the same condition as in Inventive Example to produce seamless metal pipes. The produced seamless metal pipes had the same dimensions as those of Inventive Example. The outer surface temperature of the hollow shell at the entrance side of the piercing machine P2 was 990° C. The presence or absence of a lamination defect in the produced seamless metal pipe was investigated by the same method as in Inventive Example.

[Investigation Results]

No lamination defect occurred in the inner surface of any of the three seamless metal pipes of Inventive Example. On the other hand, a lamination defect occurred in the inner surface of any of the three seamless metal pipes of Comparative Example.

While embodiments of the present invention have been described so far, the above described embodiments are merely illustrations to practice the present invention. Therefore, the present invention will not be limited to the above described embodiments, and can be practiced by appropriately modifying the above described embodiments within a range not departing from the spirit of the present invention.

The invention claimed is:

1. A method of producing a seamless metal pipe comprising the steps of:

heating a high alloy billet containing, by mass %, Cr: 20 to 30% and Ni: more than 22% and not more than 60% in a first heating furnace;

piercing-rolling the high alloy billet heated in the first heating furnace with a first piercing machine to produce a hollow shell, the first piercing machine including a pair of skew rolls and a plug;

heating the hollow shell in a second heating furnace immediately after piercing-rolling; and elongation-rolling the hollow shell heated in the second heating furnace with the first piercing machine or a second piercing machine which is different from the first piercing machine and includes a pair of skew rolls and a plug.

2. The method of producing a seamless metal pipe according to claim 1, wherein in the step of heating the hollow shell in the second heating furnace, the hollow shell whose outer surface temperature is not less than 1000° C. is charged into the second heating furnace.

3. The method of producing a seamless metal pipe according to claim 2, wherein in the step of heating the hollow shell in the second heating furnace, the heating time is not less than 300 seconds.

4. The method of producing a seamless metal pipe according to claim 2, wherein in the step of piercing-rolling, a piercing ratio defined by Formula (1) is from 1.1 to not more than 2.0; and in the step of elongation-rolling, an elongation ratio defined by Formula (2) is from 1.05 to not more than 2.0, and a total elongation ratio defined by Formula (3) is more than 2.0:

piercing ratio=hollow shell length after piercing-rolling/billet length before piercing-rolling (1)

elongation ratio=hollow shell length after elongation-rolling/hollow shell length before elongation-rolling (2)

total elongation ratio=hollow shell length after elongation-rolling/billet length before piercing-rolling (3).

5. The method of producing a seamless metal pipe according to claim 1, wherein in the step of piercing-rolling, a piercing ratio defined by Formula (1) is from 1.1 to not more than 2.0; and in the step of elongation-rolling, an elongation ratio defined by Formula (2) is from 1.05 to not more than 2.0, and a total elongation ratio defined by Formula (3) is more than 2.0:

piercing ratio=hollow shell length after piercing-rolling/billet length before piercing-rolling (1)

elongation ratio=hollow shell length after elongation-rolling/hollow shell length before elongation-rolling (2)

total elongation ratio=hollow shell length after elongation-rolling/billet length before piercing-rolling (3).

* * * * *